US011234522B1

(12) United States Patent
Marvin

(10) Patent No.: US 11,234,522 B1
(45) Date of Patent: Feb. 1, 2022

(54) SUPPORT MOUNTABLE SEAT ASSEMBLY

(71) Applicant: Joel Marvin, Hudson, WI (US)

(72) Inventor: Joel Marvin, Hudson, WI (US)

( * ) Notice: Subject to any disclaimer, the term of this patent is extended or adjusted under 35 U.S.C. 154(b) by 0 days.

(21) Appl. No.: 17/028,604

(22) Filed: Sep. 22, 2020

(51) Int. Cl.

| | |
|---|---|
| ***B63B 29/04*** | (2006.01) |
| ***A47C 1/16*** | (2006.01) |
| ***A47C 3/16*** | (2006.01) |
| ***A47C 7/52*** | (2006.01) |
| ***A47C 4/30*** | (2006.01) |
| ***A47C 9/06*** | (2006.01) |

(52) U.S. Cl.
CPC ..... *A47C 3/16* (2013.01); *A47C 1/16* (2013.01); *A47C 4/30* (2013.01); *A47C 7/52* (2013.01); *A47C 9/06* (2013.01); *B63B 29/04* (2013.01); *B63B 2029/043* (2013.01)

(58) Field of Classification Search
CPC ..... B63B 2029/043; B63B 29/04; A47D 1/10; A47D 1/106; A47C 7/52; A47C 1/16; A47C 9/06; A47C 3/16; A47C 4/30
USPC ..... 297/16.1, 35, 37, 174 CS, 255, 423.4; 114/362, 363; 182/150; 248/229.15, 248/229.25, 231.71
See application file for complete search history.

(56) References Cited

U.S. PATENT DOCUMENTS 834,383 A * 10/1906 Johnson ..... A47D 1/103 297/152
839,944 A * 1/1907 Martin ..... B60N 2/286 297/254
1,223,272 A * 4/1917 Gurly ..... A47C 7/402 297/298
1,530,954 A * 3/1925 Panagopulos ..... A47D 1/103 297/183.1
2,333,734 A * 11/1943 Nieltopp ..... A47C 9/06 297/188.01
2,483,552 A * 10/1949 Lincoln ..... A47C 15/004 297/252
2,540,672 A * 2/1951 Holmes ..... A47D 1/106 297/174 CS
2,612,207 A * 9/1952 Branson ..... B60N 2/3011 297/331
2,690,790 A * 10/1954 Linden ..... B60N 2/286 297/255
2,709,563 A * 5/1955 Starkey ..... A47B 1/04 248/231.85
2,710,643 A * 6/1955 Wincey ..... A47D 1/106 297/174 CS
2,731,072 A * 1/1956 Post ..... A47D 1/023 297/6
2,827,949 A * 3/1958 Kershaw ..... A47C 3/0255 297/452.63

(Continued)

FOREIGN PATENT DOCUMENTS

CH 301390 A * 9/1954 ..... A47D 1/106
CH 311752 A * 12/1955 ..... A47D 1/106

(Continued)

*Primary Examiner* — Robert Canfield

(57) ABSTRACT

A support mountable seat assembly includes a seat having a front end, a back end, a first lateral edge and a second lateral edge. A backrest has a bottom end and a top end. The backrest is attached to and extends upwardly from the back end. The backrest includes a coupler that is attached to the backrest. The coupler receives an outer edge of a support and releasably engages an upper side and lower side of the support.

14 Claims, 8 Drawing Sheets

(56) References Cited

U.S. PATENT DOCUMENTS 2,988,310 A * 6/1961 Wright ..... A45B 11/00 248/511
3,146,026 A * 8/1964 Berlin ..... A47D 1/103 297/255
3,195,680 A * 7/1965 Thornburg ..... B63B 27/14 182/92
3,289,615 A * 12/1966 Marschak ..... A47B 97/00 108/97
3,397,010 A * 8/1968 Leimgruber ..... A47D 1/02 297/174 CS
3,428,361 A * 2/1969 Reynolds ..... A47D 1/10 297/182
4,312,536 A * 1/1982 Lloyd ..... A47C 15/004 182/150
4,315,655 A * 2/1982 Machnik ..... A45F 3/26 182/187
4,575,073 A * 3/1986 Thacker ..... A63G 9/00 297/273
4,799,447 A 1/1989 Herbert
4,837,869 A * 6/1989 Simmon ..... A47C 15/006 297/14
5,025,747 A 6/1991 Grayson
5,307,572 A 5/1994 Engel
5,462,334 A * 10/1995 Sedorcek ..... A47C 9/06 297/252
5,711,240 A 1/1998 Baker
5,857,226 A * 1/1999 Sommer ..... A47C 15/004 4/496
5,988,737 A * 11/1999 Tomaiuolo ..... A47C 4/52 297/129
6,227,330 B1 * 5/2001 Preusser ..... E01D 19/106 182/142
6,296,241 B1 * 10/2001 Harrison ..... B25B 5/10 269/172
6,311,343 B1 * 11/2001 Wisniewski ..... E04H 4/144 4/496
7,322,655 B1 * 1/2008 Williams ..... A47C 7/52 297/423.15
7,819,467 B1 * 10/2010 Schimmeyer ..... B62B 5/085 297/14
8,028,641 B1 10/2011 Sly
8,240,760 B2 8/2012 Scheurer
8,356,568 B1 * 1/2013 Chinn ..... B63B 27/146 114/362
8,365,864 B1 * 2/2013 Sherer ..... E04G 5/045 182/150
9,212,497 B2 * 12/2015 Chlapaty ..... A47C 4/28
9,334,023 B2 5/2016 Admire
9,340,258 B1 5/2016 Long
9,428,249 B2 8/2016 Heimerl
9,474,380 B2 * 10/2016 Chlapaty ..... A47C 1/14
9,475,554 B2 10/2016 Heimerl
9,993,090 B2 * 6/2018 Hsu ..... A47D 1/106
10,479,454 B2 11/2019 Barkwick
10,786,073 B1 * 9/2020 Dillard ..... A47B 5/02
2007/0186840 A1 * 8/2007 Dvorak ..... B63B 27/146 114/362
2008/0093895 A1 * 4/2008 Deckert ..... A47C 4/48 297/45
2009/0243349 A1 * 10/2009 Flannery ..... A47D 1/106 297/174 CS
2010/0038936 A1 * 2/2010 Gibson ..... A47D 1/106 297/174 CS
2013/0205492 A1 * 8/2013 Slater ..... A61H 33/00 4/578.1
2014/0265510 A1 * 9/2014 Storm ..... A61G 5/12 297/423.4
2015/0336487 A1 * 11/2015 Blackledge ..... B60N 2/995 297/250.1
2019/0054983 A1 * 2/2019 Barwick ..... A47C 1/146
2020/0047855 A1 * 2/2020 Barwick ..... B63B 29/04
2020/0281413 A1 * 9/2020 Fabre ..... A47K 3/127

FOREIGN PATENT DOCUMENTS

FR 983145 A * 6/1951 ..... A47D 1/106
FR 1416709 A * 11/1965 ..... A47C 7/52
GB 2068716 A * 8/1981 ..... A47D 1/106
GB 2245161 A * 1/1992 ..... B60N 2/286

* cited by examiner

SUPPORT MOUNTABLE SEAT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to boat mountable seat device and more particularly pertains to a new boat mountable seat device for allowing a person to removably attach a seat to a support such that the person may sit in water while being statically attached and supported by the seat.

(2) Description of Related Art Including Information Disclosed Under 37 CFR 1.97 and 1.98

The prior art relates generally to boat mountable seat devices and to chair assemblies that are removably attached to supporting devices such that the seat does not require legs.

BRIEF SUMMARY OF THE INVENTION

An embodiment of the disclosure meets the needs presented above by generally comprising a seat having a front end, a back end, a first lateral edge and a second lateral edge. A backrest has a bottom end and a top end. The backrest is attached to and extends upwardly from the back end. The backrest includes a coupler that is attached to the backrest. The coupler is configured to receive an outer edge of a support and releasably engage an upper side and lower side of the support.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
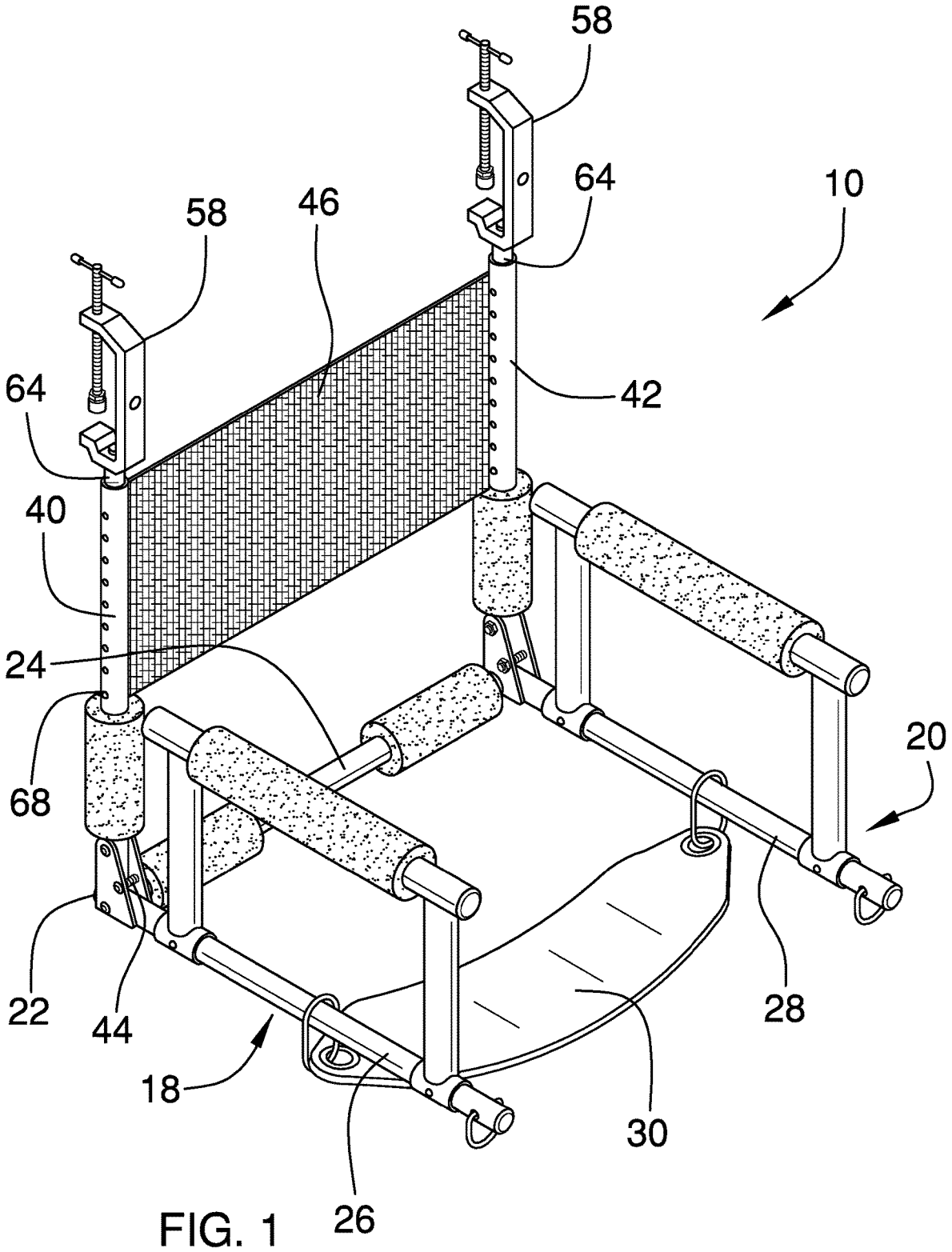
FIG. 1 is a front isometric view of a support mountable seat assembly according to an embodiment of the disclosure.

With reference now to the drawings, and in particular to FIGS. 1 through 8 thereof, a new boat mountable seat device embodying the principles and concepts of an embodiment of the disclosure and generally designated by the reference numeral 10 will be described.

As best illustrated in FIGS. 1 through 8, the support mountable seat assembly 10 generally comprises a seat 12 that has a front end 14, a back end 16, a first lateral edge 18 and a second lateral edge 20. The seat 12 includes a seat frame 22 including a back rod 24 extending along the back end 16. A first lateral rod 26 and a second lateral rod 28 are each attached to and extend in a same direction away from the back rod 24. Each of the first 26 and second 28 lateral rods extends from the front end 14 to the back 16 end. A seat panel 30 is attached to and extends between the first 26 and second 28 lateral rods. While the seat panel 30 may be comprised of any conventional material including rigid materials, the seat panel 30 may be comprised of a flexible material such that it forms a sling that receives a user's buttocks. The seat panel 30 may be comprised of a water impervious material such as plastics and elastomeric materials, though canvas and other fluid absorptive materials may be utilized. The seat panel 30 may be removably attached to the seat frame 22 such as with loops 32 attached to opposite ends of the seat panel 30 and through which the first 26 and second 28 lateral rods are extended. This will also allow the seat panel 30 to be moved nearer or farther away from the back end 16 for comfort adjustability.

A backrest 34 has a bottom end 36 and a top end 38. The backrest 34 is attached to and extends upwardly from the back end 16. The backrest 34 includes a first lateral post 40 attached to the first lateral rod 26 and a second lateral post 42 attached to the second lateral rod 28. The first 40 and second 42 lateral posts are pivotable between an upright position and a stored position relative to the first 26 and second 28 lateral rods, thus the backrest 34 is pivoted to selectively collapse downwardly for storage and transportation purposes. When mounted to a support 52 as described below, the seat 12 may be folded upwardly against the backrest 34 such that the assembly 10 is essentially stored in a hanging position from the support 52. The upright position forms an angle between the seat 12 and the backrest 34 that is typically between 80° and 100° while the stored position is defined as the backrest 34 being folded downwardly toward the seat 12. As can be seen in the FIG. 1, a stop 44 may be used to retard rearward pivoting of the backrest 34 beyond a selected angle relative to the seat 12. A back panel 46 is attached to and extends between the first 40 and second 42 lateral posts. The back panel 46 may comprise any conventional material against which a person's back might rest including flexible fabrics or panels which are rigid or resiliently compressible.

Figure 3:
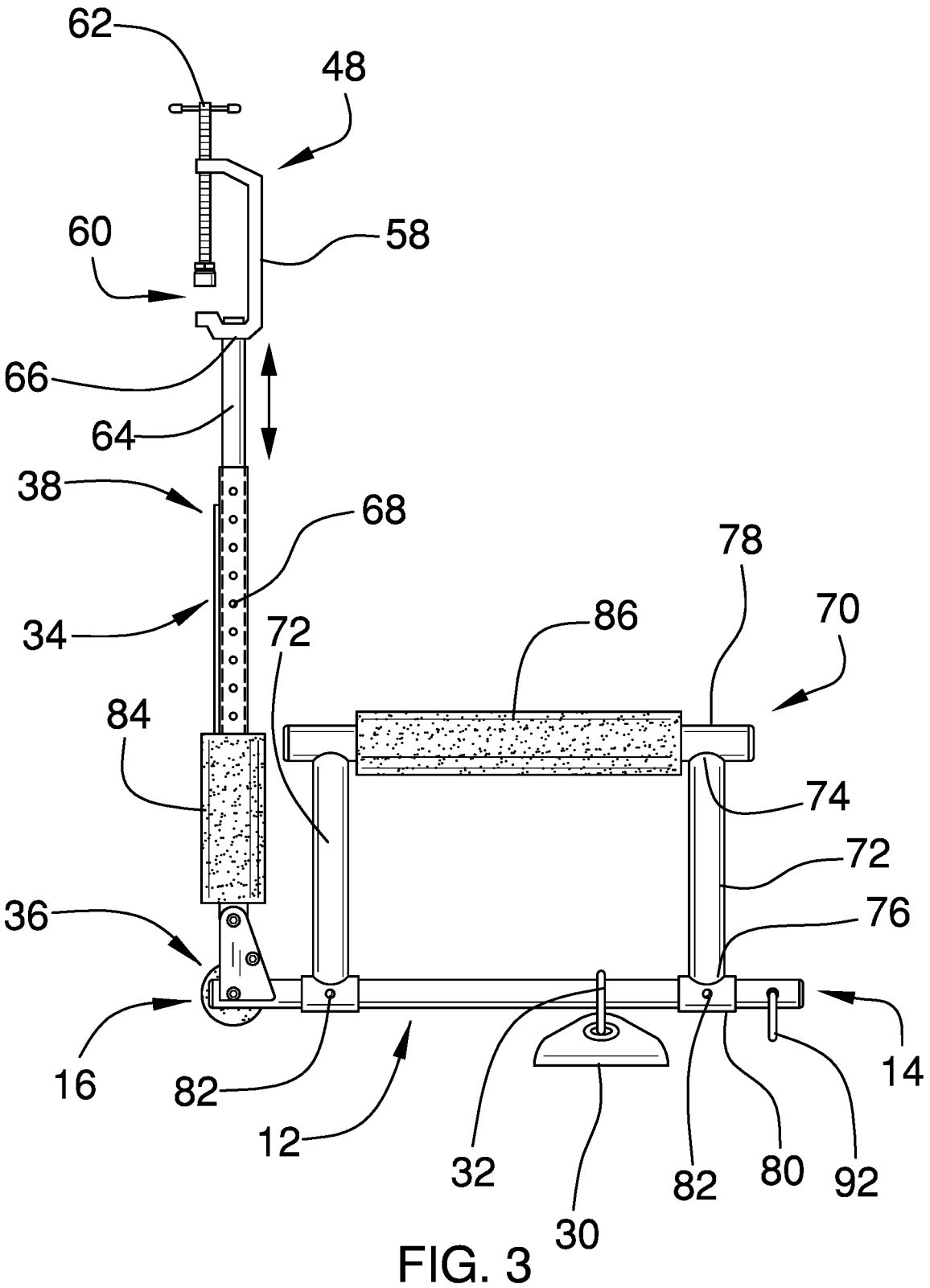
FIG. 3 is a side view of an embodiment of the disclosure.
Figure 4:
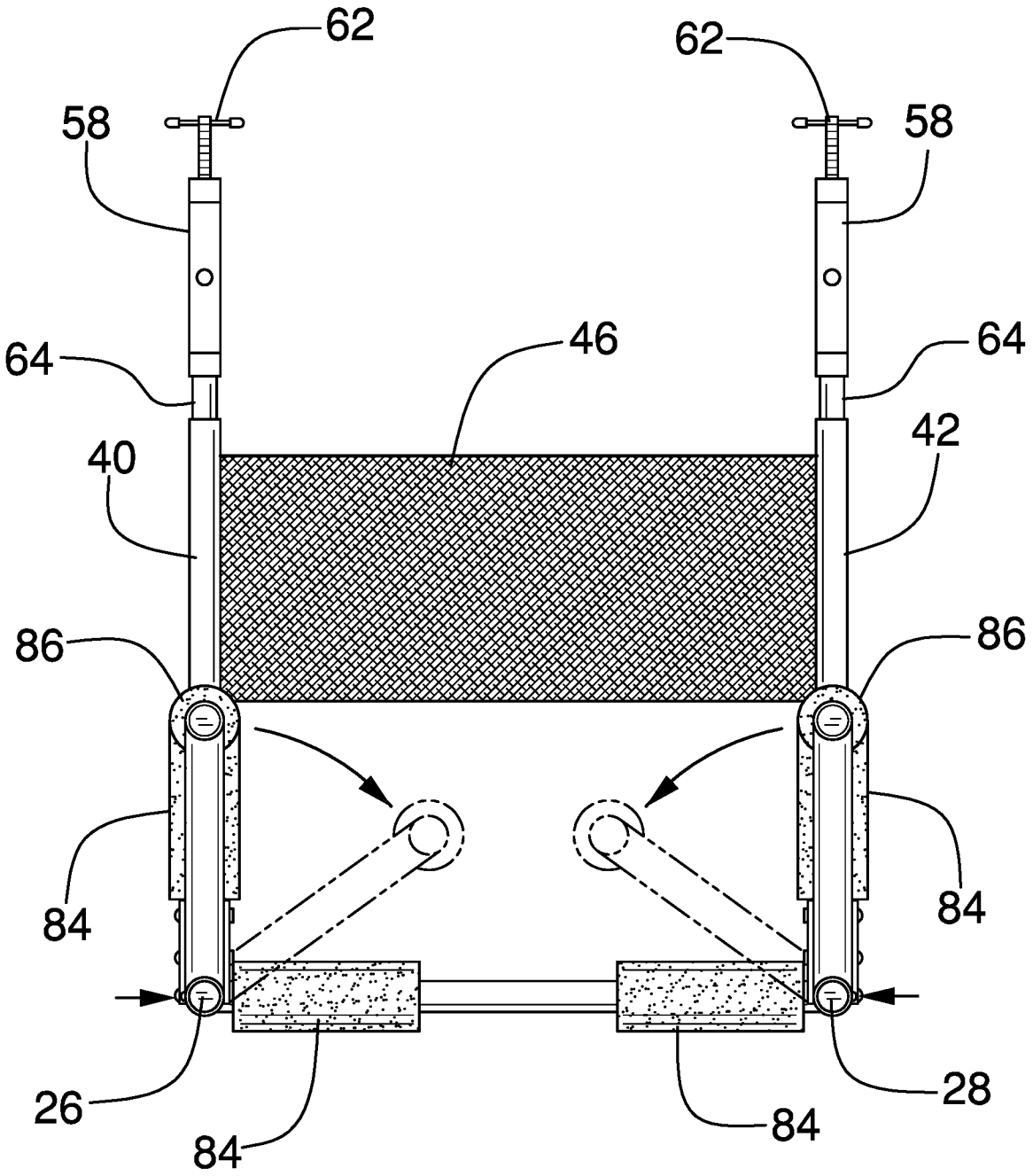
FIG. 4 is a rear view of an embodiment of the disclosure.
Figure 5:
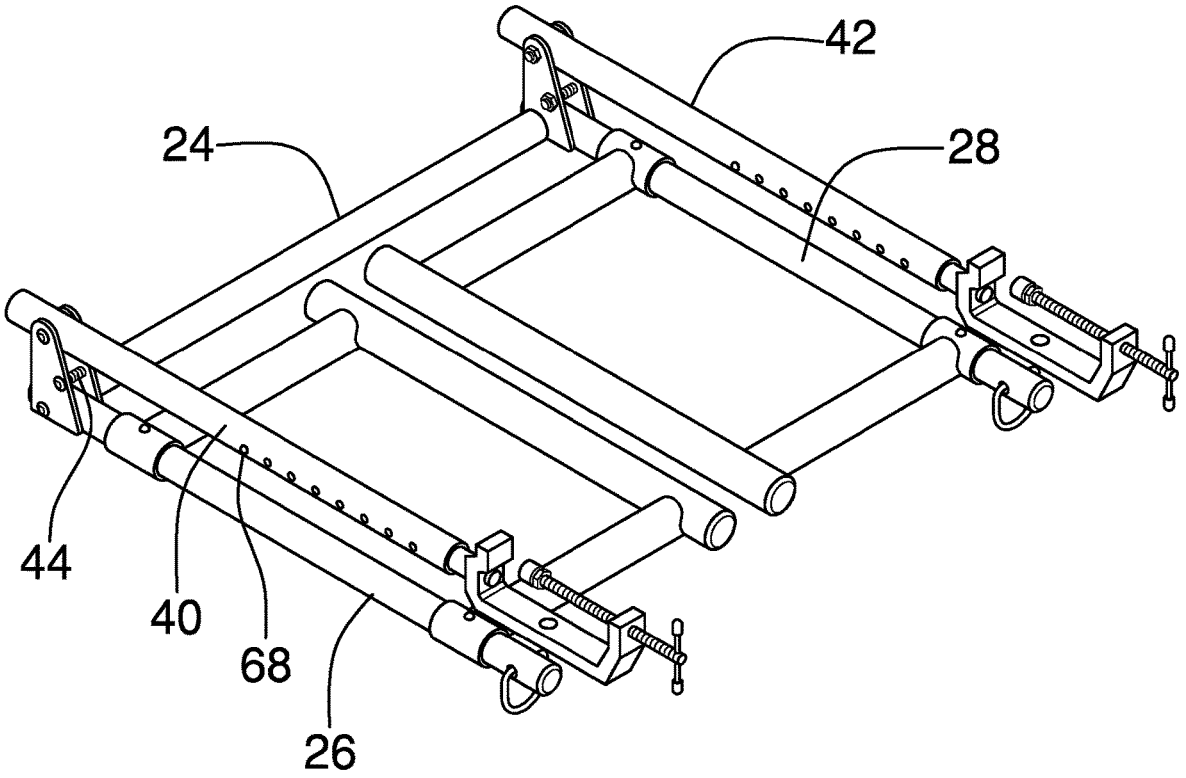
FIG. 5 is a top isometric view of an embodiment of the disclosure.
Figure 6:
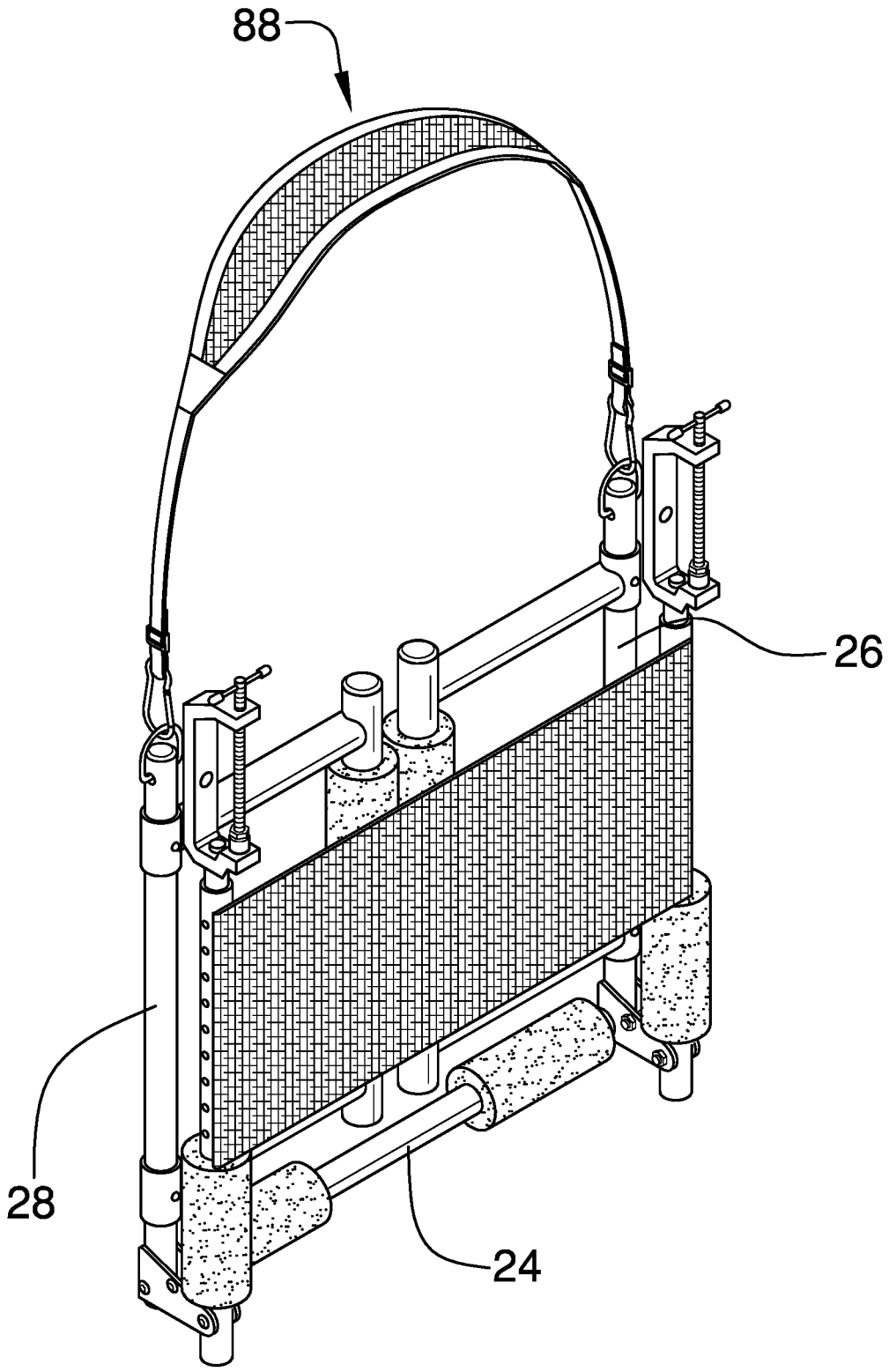
FIG. 6 is a side and rear isometric view of an embodiment of the disclosure.

A coupler 48 is attached to the backrest 34 and is configured to receive an outer edge 50 of a support 52 and releasably engage an upper side and lower side of the support 52. While the support 52 may be any structure upon which a person is supported or walks including planks and decks, the coupler 48 is particularly configured to engage the deck of a pontoon boat which laterally extends outwardly from floats 54 of the pontoon boat 56. The coupler 48 includes a pair of brackets 58. As shown in FIG. 3, each of the brackets 58 has an opening 60 facing rearward of the backrest 34 to receive the edge 50 of the support 52, or deck. The brackets 58 each include a closure 62 for engaging the support. As can be seen in the Figures, the closure 62 may comprise a screw-type vise though any frictionally engaging clamp may be utilized.

The coupler 48 may also include a pair of rods 64, wherein each of the rods 64 is telescopically coupled to and is extendable upwardly from one of the first 40 and second 42 lateral posts. Each of the rods 64 has an upper end 66, and each of the brackets 58 is attached to one of the upper ends 66. Consequently, a user may alter the vertical position of the seat 12 relative to the deck, or support 52, by extending or retracting the rods 64 from first 40 and second 42 lateral posts. Conventional pins or spring-loaded detents 68 may be utilized, for example, to releasably retain the rods 64 in engagement with an associated one of the first 40 and second 42 lateral posts.

A pair of armrests 70 may be provided, wherein each of the first 26 and second 28 lateral rods has one of the armrests 70 attached thereto. In one embodiment, each of the armrests 70 includes a pair of legs 72 each having an upper end 74 and a lower end 76, and a central member 78 attached to and extending between the upper ends 74 of the legs 72. A pair of sleeves 80 is provided and each of the lower ends 76 is attached to one of the sleeves 80. The sleeves 80 are rotatably mounted on an associated one of the first 26 and second 28 lateral rods such that the legs 72 are rotatable between an upward position and a horizontal position. The sleeves 80 may be made to be slidably removable from the first 26 and second 28 lateral rods to allow the armrests 70 to not be used or to be added later as an accessory. The sleeves 80 may be lockable in place with a pin or detent 82, for example, to retain the armrests 70 in the deployed, upward position or in the stored, horizontal position. It should be understood that a single leg 72 and sleeve 80 per armrest 70 may be utilized for the armrests 70 to function as needed.

Figure 2:
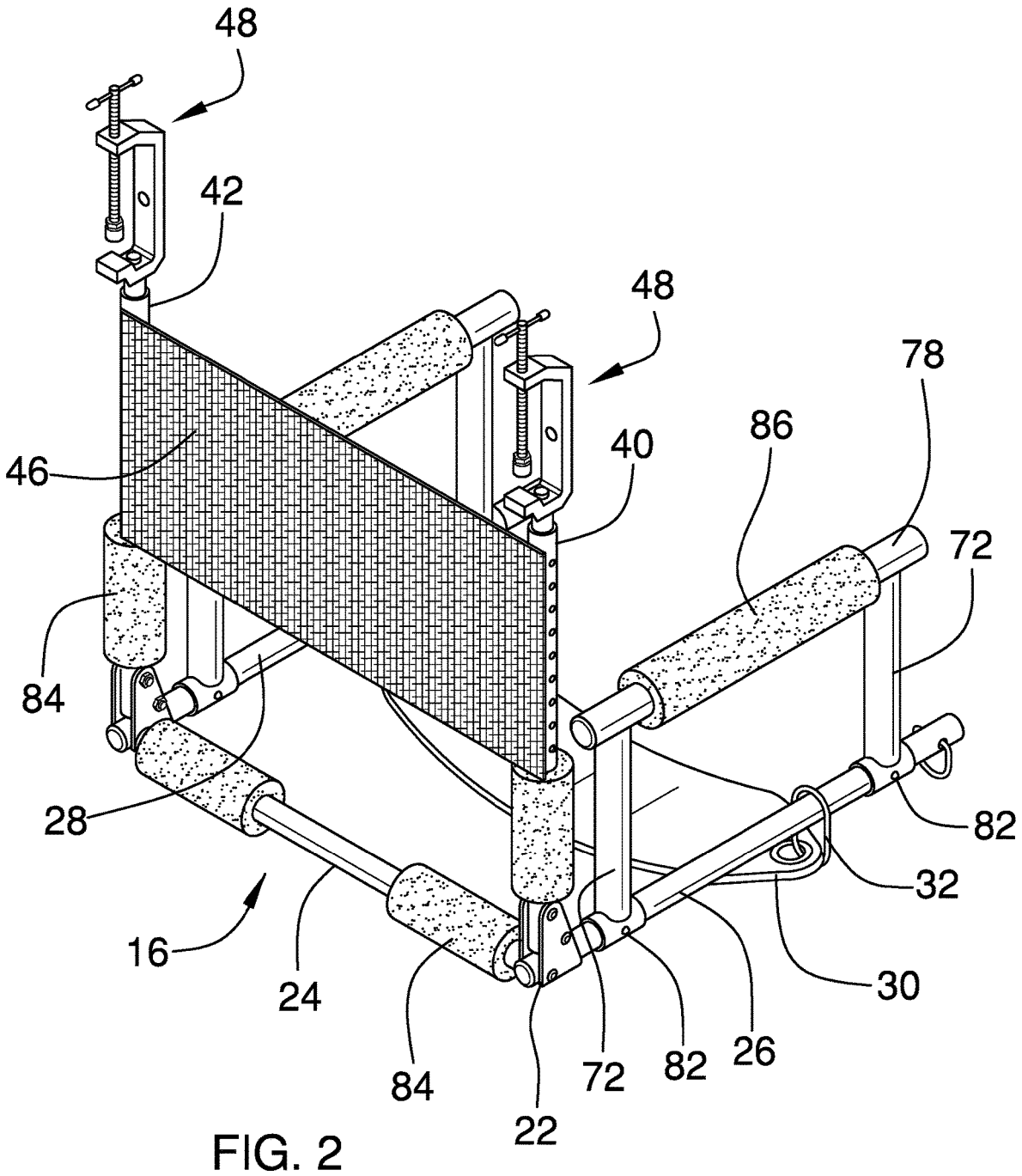
FIG. 2 is a rear isometric view of an embodiment of the disclosure.

A plurality of support cushions 84 may be attached to the backrest 34 such that the support cushions 84 extend rearwardly therefrom. Alternatively, a single support cushion 84 may be utilized if it is centrally located and has a sufficient width. Each of the first 40 and second 42 lateral posts may have one of the support cushions 84 positioned thereon. The support cushions 84 protect the pontoon boat 56 from the assembly 10. Additional support cushions 84 may be positioned on the back rod 24 as best seen in FIG. 2. For the comfort of a user of the assembly 10, a pair of arm cushions 86 may be provided wherein each of the armrests 70 has one of the arm cushions 86 positioned thereon. The support 84 and arm 86 cushions may be comprised of a buoyant material such that the assembly 10 floats in water. Foamed elastomeric materials may be preferred materials though any resiliently compressible material used for cushioning may be utilized.

Figure 7:
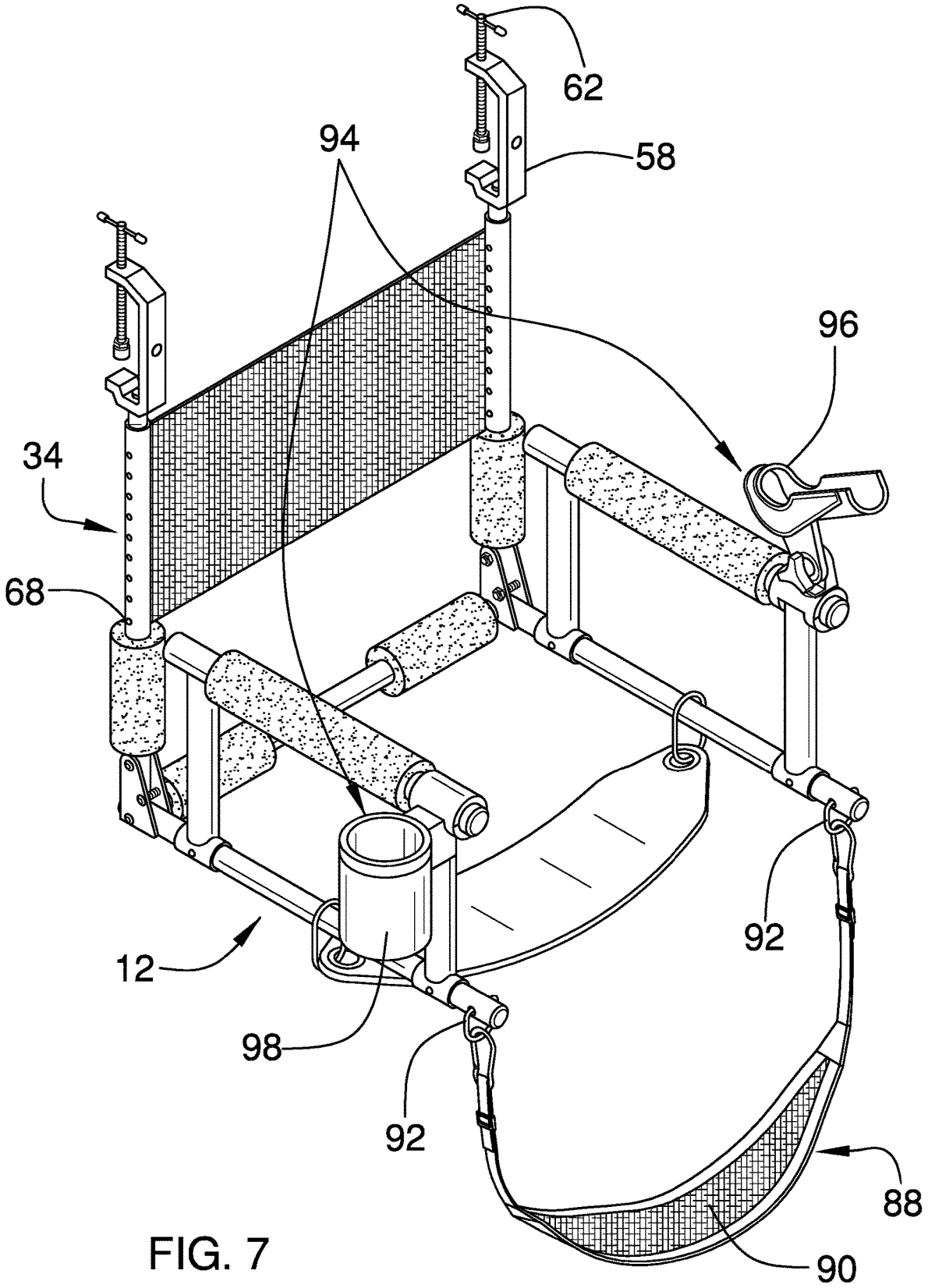
FIG. 7 is a front isometric view of an embodiment of the disclosure.
Figure 8:
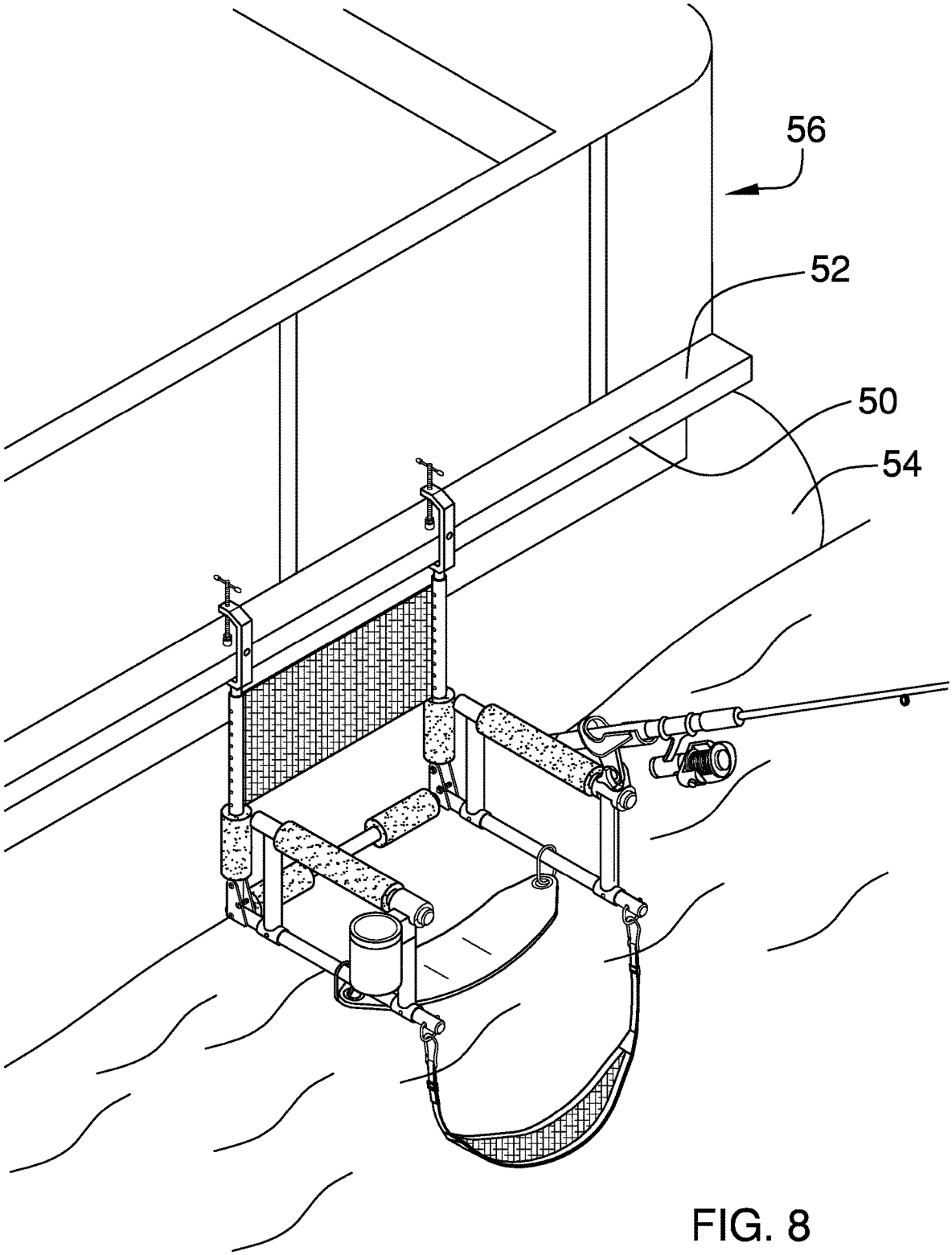
FIG. 8 is an in-use front isometric view of an embodiment of the disclosure.

A foot sling 88 may be attached to the seat 12 adjacent to the front end 14 and extend downwardly from the seat 12 a distance greater than 8.0 inches and may be adjustable to accommodate a user's preferences. The foot sling 88 may comprise an elongated flexible panel 90 that is extended between and attached to the first 26 and second 28 lateral rods. The Figures demonstrate rings 92 on the seat 12 that serve as removable attachment points for clips or hooks secured to opposite ends of the elongated flexible panel 90. As seen in FIG. 7, the foot sling 88 is positioned to support the feet of a user of the assembly 10 while FIG. 6 demonstrates the foot sling's 88 usage as a shoulder strap for carrying the assembly 10.

FIG. 7 includes accessories 94, such as a fishing rod holder 96 and beverage holder 98, that may also be attached to the armrests 70. More particularly the accessories 94 are positioned on the central member 78 to allow the armrests 70 to support the accessories 94 above the water surface when the armrests 70 are in the upright position. Other attachable accessories 94 such as umbrella holders are contemplated and all accessories 94 may be attached to the armrests or other points on the assembly 10 with conventional clamps and brackets.

In use, the assembly 10 is mounted onto the support 52, such as a pontoon boat 56 deck, with the coupler 48 as described above and shown in FIG. 8. Before or after the coupler 48 is attached to the support 52, the rods 64 may be extended or retracted relative to the water to allow the user to determine how low they will sit in the water. The assembly 10 is then used as a conventional chair to provide a seating area adjacent to the support 52 while engaging in activities such as relaxing, conversing with others or fishing. When not in use, the seat 12 may be folded upwardly against the backrest 34 to allow the pontoon boat 56 to be movable without removal of the assembly 10 from the support 52.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A chair assembly configured for engagement with and suspension from a support, the assembly comprising:

a seat having a front end, a back end, a first lateral edge and a second lateral edge;

a backrest having a bottom end and a top end, the backrest being attached to and extending upwardly from the back end, the backrest including; and a coupler being attached to the backrest, the coupler being configured to receive an outer edge of a support and releasably engage an upper side and lower side of the support; and a plurality of support cushions being attached to the backrest and extending rearwardly therefrom.

2. The chair assembly according to claim 1, wherein the seat includes:

a seat frame including a back rod extending along the back end, a first lateral rod and a second lateral rod each being attached to and extending in a same direction away from the back rod, each of the first and second lateral rods extending from the front end to the back end; and a seat panel being attached to and extending between the first and second lateral rods.

3. The chair assembly according to claim 2, wherein the seat panel is comprised of a flexible material.

4. The chair assembly according to claim 3, wherein the seat panel is removably attached to the seat frame.

5. The chair assembly according to claim 2, wherein the backrest includes:

a first lateral post being attached to the first lateral rod;

a second lateral post being attached to the second lateral rod;

the first and second lateral posts being pivotable between an upright position and a stored position relative to the first and second lateral rods, the upright position forming an angle between the seat and the backrest between 80° and 100°, the stored position being defined as the backrest being folded downwardly toward the seat; and a back panel being attached to and extending between the first and second lateral posts.

6. The chair assembly according to claim 5, wherein the coupler includes a pair of brackets, each of the brackets having an opening facing rearward of the backrest, the brackets each including a closure for engaging the support.

7. The chair assembly according to claim 2, further including a pair of armrests, each of the first and second lateral rods having one of the armrests attached thereto.

8. The chair assembly according to claim 1, wherein the backrest is movable with respect to the seat from an upright position to a stored position.

9. The chair assembly according to claim 1, wherein the coupler includes a pair of brackets, each of the brackets having an opening facing rearward of the backrest, the brackets each including a closure for engaging the support.

10. A chair assembly configured for engagement with and suspension from a support, the assembly comprising:

a seat having a front end, a back end, a first lateral edge and a second lateral edge;

a backrest having a bottom end and a top end, the backrest being attached to and extending upwardly from the back end, the backrest including;

a coupler being attached to the backrest, the coupler being configured to receive an outer edge of a support and releasably engage an upper side and lower side of the support, wherein the coupler includes a pair of brackets, each of the brackets having an opening facing rearward of the backrest, the brackets each including a closure for engaging the support;

wherein the seat includes:

a seat frame including a back rod extending along the back end, a first lateral rod and a second lateral rod each being attached to and extending in a same direction away from the back rod, each of the first and second lateral rods extending from the front end to the back end; and a seat panel being attached to and extending between the first and second lateral rods;

wherein the backrest includes:

a first lateral post being attached to the first lateral rod;

a second lateral post being attached to the second lateral rod;

the first and second lateral posts being pivotable between an upright position and a stored position relative to the first and second lateral rods, the upright position forming an angle between the seat and the backrest between 80° and 100°, the stored position being defined as the backrest being folded downwardly toward the seat; and a back panel being attached to and extending between the first and second lateral posts; and wherein the coupler further includes a pair of rods, each of the rods being telescopically coupled to and being extendable upwardly from one of the first and second lateral posts, each of the rods having an upper end, each of the brackets being attached to one of the upper ends.

11. A chair assembly configured for engagement with and suspension from a support, the assembly comprising:

a seat having a front end, a back end, a first lateral edge and a second lateral edge;

a backrest having a bottom end and a top end, the backrest being attached to and extending upwardly from the back end, the backrest including;

a coupler being attached to the backrest, the coupler being configured to receive an outer edge of a support and releasably engage an upper side and lower side of the support;

wherein the seat includes:

a seat frame including a back rod extending along the back end, a first lateral rod and a second lateral rod each being attached to and extending in a same direction away from the back rod, each of the first and second lateral rods extending from the front end to the back end; and a seat panel being attached to and extending between the first and second lateral rods; and a pair of armrests, each of the first and second lateral rods having one of the armrests attached thereto, wherein each of the armrests includes:

a pair of legs each having an upper end and a lower end;

a central member being attached to and extending between the upper ends of the legs; and a pair of sleeves, each of the lower ends being attached to one of the sleeves, the sleeves being rotatably mounted on an associated one of the first and second lateral rods such that the legs are rotatable between an upward position and a horizontal position.

12. The chair assembly according to claim 11, further including a pair of arm cushions, each of the armrests having one of the arm cushions positioned thereon.

13. A chair assembly configured for engagement with and suspension from a support, the assembly comprising:

a seat having a front end, a back end, a first lateral edge and a second lateral edge;

a backrest having a bottom end and a top end, the backrest being attached to and extending upwardly from the back end, the backrest including;

a coupler being attached to the backrest, the coupler being configured to receive an outer edge of a support and releasably engage an upper side and lower side of the support;

wherein the seat includes:

a seat frame including a back rod extending along the back end, a first lateral rod and a second lateral rod each being attached to and extending in a same direction away from the back rod, each of the first and second lateral rods extending from the front end to the back end; and a seat panel being attached to and extending between the first and second lateral rods;

wherein the backrest includes:

a first lateral post being attached to the first lateral rod;

a second lateral post being attached to the second lateral rod;

the first and second lateral posts being pivotable between an upright position and a stored position relative to the first and second lateral rods, the upright position forming an angle between the seat and the backrest between 800 and 100°, the stored position being defined as the backrest being folded downwardly toward the seat; and a back panel being attached to and extending between the first and second lateral posts; and a plurality of support cushions being attached to the backrest and extending rearwardly therefrom, each of the first and second lateral posts having one of the support cushions positioned thereon.

14. A chair assembly configured for engagement with and suspension from a support, the assembly comprising:

a seat having a front end, a back end, a first lateral edge and a second lateral edge, the seat including:

a seat frame including a back rod extending along the back end, a first lateral rod and a second lateral rod each being attached to and extending in a same direction away from the back rod, each of the first and second lateral rods extending from the front end to the back end;

a seat panel being attached to and extending between the first and second lateral rods, the seat panel being comprised of a flexible material, the seat panel being removably attached to the seat frame;

a backrest having a bottom end and a top end, the backrest being attached to and extending upwardly from the back end, the backrest including:

a first lateral post being attached to the first lateral rod;

a second lateral post being attached to the second lateral rod;

the first and second lateral posts being pivotable between an upright position and a stored position relative to the first and second lateral rods, the upright position forming an angle between the seat and the backrest between 800 and 100°, the stored position being defined as the backrest being folded downwardly toward the seat;

a back panel being attached to and extending between the first and second lateral posts;

a coupler being attached to the backrest, the coupler being configured to receive an outer edge of a support and releasably engage an upper side and lower side of the support, the coupler including:

a pair of brackets, each of the brackets having an opening facing rearward of the backrest, the brackets each including a closure for engaging the support;

a pair of rods, each of the rods being telescopically coupled to and being extendable upwardly from one of the first and second lateral posts, each of the rods having an upper end, each of the brackets being attached to one of the upper ends;

a pair of armrests, each of the first and second lateral rods having one of the armrests attached thereto, each of the armrests including:

a pair of legs each having an upper end and a lower end;

a central member being attached to and extending between the upper ends of the legs;

a pair of sleeves, each of the lower ends being attached to one of the sleeves, the sleeves being rotatably mounted on an associated one of the first and second lateral rods such that the legs are rotatable between an upward position and a horizontal position;

a plurality of support cushions being attached to the backrest and extending rearwardly therefrom, each of the first and second lateral posts having one of the support cushions positioned thereon; and a pair of arm cushions, each of the armrests having one of the arm cushions positioned thereon.

* * * * *